US006238114B1

(12) United States Patent
Bennett, III et al.

(10) Patent No.: US 6,238,114 B1
(45) Date of Patent: May 29, 2001

(54) PRINT MEDIA HANDLING SYSTEM AND METHOD OF USING SAME

(75) Inventors: Robert Dan Bennett, III, Kuttawa; Michael Craig Leemhuis, Nicholasville; David Kyle Murray, Lexington, all of KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 09/518,493

(22) Filed: Mar. 3, 2000

(51) Int. Cl.[7] ..... B41J 11/58; B65H 31/10

(52) U.S. Cl. ..... 400/625; 101/485; 101/420; 347/104; 271/213; 271/218

(58) Field of Search ..... 400/579, 624, 400/625, 629; 347/102, 104; 271/213, 218, 209, 220, 278, 207, 189; 101/485, 420; 198/457.05

(56) References Cited

U.S. PATENT DOCUMENTS

| | | | | |
|---|---|---|---|---|
| 2,643,757 | * | 6/1953 | Kovatch | 198/457.05 |
| 3,651,961 | * | 3/1972 | Hayes | 271/189 |
| 4,265,444 | * | 5/1981 | Berglund | 271/207 |
| 4,469,321 | * | 9/1984 | Geschwinder | 271/183 |
| 4,605,211 | * | 8/1986 | Sonobe | 271/213 |
| 4,728,963 | | 3/1988 | Rasmussen et al. . | |
| 4,794,859 | | 1/1989 | Huseby et al. | 101/485 |
| 4,844,633 | | 7/1989 | Greenberg . | |
| 5,226,743 | | 7/1993 | Jackson et al. . | |
| 5,451,044 | | 9/1995 | Nakayama . | |
| 5,536,000 | | 7/1996 | Kelly | 271/213 |
| 5,686,950 | | 11/1997 | Hirakue . | |
| 5,745,141 | | 4/1998 | Miyawaki . | |
| 5,767,884 | | 6/1998 | Bortolotti et al. . | |
| 5,769,413 | | 6/1998 | Hummel et al. . | |
| 6,027,269 | * | 2/2000 | Yoshida | 400/625 |
| 6,092,948 | * | 7/2000 | Altfather | 400/625 |

* cited by examiner

*Primary Examiner*—Eugene Eickholt
(74) *Attorney, Agent, or Firm*—Taylor & Aust, P.C.

(57) ABSTRACT

A print media handling system for an imaging apparatus having a media feed path includes a pair of media support members, each have a first wall defining a media contact surface and a support portion defining a media support surface. The pair of media support members are pivotally mounted to the imaging apparatus for symmetrical operation with respect to a centerline of the media feed path. The pair of media support members define a media bin for receiving printed media. The print media handling system further includes a drive system for operating the pair of media support members between a first position wherein the media support surface of the pair of support members carries a printed media sheet and a second position wherein the printed media sheet is released to fall into the media bin. The drive system further controls the pair of media support members such that the contact surface of each of the pair of media support members contacts opposing edges of the printed media to align the printed media in the media bin.

18 Claims, 4 Drawing Sheets

PRINT MEDIA HANDLING SYSTEM AND METHOD OF USING SAME

BACKGROUND OF THE INVENTION

1. Field of the Invention

The present invention relates to a printing system, and more particularly, to a print media handling system and associated method.

2. Description of the Related Art

In a typical ink jet printer, print media is directed through a print cycle which includes picking a media sheet from an input tray, transporting the media sheet through a printing zone for printing, and then transporting the printed sheet through an output port. Once the printed sheet exits the output port, the printed sheet is received by an output tray. Consecutive printed sheets are piled one on top of another as successive sheets are printed to form an output stack. Since ink jet printers print with a liquid ink, and because sheets often are stacked immediately after printing, ink jet printers have in the past experienced some difficulty with smearing of ink upon contact of a previously printed sheet by an immediately subsequent printed sheet. This has been particularly apparent where ink drying time exceeds the time between the printing of consecutive sheets.

A variety of approaches have been used in attempting to deal with this problem. For example, some manufactures have attempted to eliminate ink smearing problems by decreasing ink drying time by employed quick-drying ink, or specially-coated paper, often resulting in poorer quality print. Also, some manufacturers have incorporated a drying lamp or heater in the printer near the printed media sheet, thus adding to the complexity of the printer, and consequently adding to the printer's price. Still other manufacturers have attempted to delay the delivery of printed sheets to the output tray so as to provide the previously printed sheet with adequate drying time.

One such an attempt to delay the delivery of printed sheets to the output tray so as to provide the previously printed sheet with adequate drying time is to use a passive sheet media drop scheme, whereby a printed sheet exiting the printer's output port is guided along rails which temporarily support the sheet above the output tray. Upon completion of printing, the sheet drops under the effect of gravity into the output tray, thereby allowing the previously printed sheet sufficient time to dry during printing of the present sheet. One problem associated with such a passive system, however, is the inability to adapt its operation to various printing environments or when a large quantity of ink is deposited on the printed sheet.

One solution to the problems associated with such a passive system is to provide an active sheet media delivery mechanism, wherein a printed sheet is guided along a pair of movable rails which temporarily support the sheet above the printer's output tray while the previously printed sheet drys. Once printing is completed, the rails retract, often pivotally, allowing the sheet to fall to an output tray below. Although generally effective, active drop mechanisms generally have presented problems due to permitting the skewing of sheets in the output tray, and as a result, generally pose limitations on output tray capacity. In addition, such active sheet media delivery mechanisms are driven cyclically by the same drive which drives the paper feed, thereby limiting operating adaptability.

SUMMARY OF THE INVENTION

The present invention provides, for example and not by way of limitation, an active sheet media delivery system and method which is driven independent of the paper feed drive, and which provides for the correcting of random skewing of multiple printed sheets as the sheets are accumulated in an output bin.

The invention comprises, in one form thereof, a print media handling system for an imaging apparatus having a media feed path, and a pair of media support members, each have a first wall defining a media contact surface and a support portion defining a media support surface. The pair of media support members are pivotally mounted to the imaging apparatus for symmetrical operation with respect to a centerline of the media feed path. The pair of media support members define a media bin for receiving printed media. The print media handling system further includes a drive system for operating the pair of media support members between a first position wherein the media support surface of the pair of support members carries a printed media sheet and a second position wherein the printed media sheet is released to fall into the media bin. The drive system further controls the pair of media support members such that the contact surface of each of the pair of media support members contacts opposing edges of the printed media to align the printed media in the media bin. In a preferred embodiment of the invention, the control system controls the pair of media support members to tap opposing edges of the printed media accumulated in the media bin on an intermittent basis, regardless of the presence of a printed sheet of media at the media support surface of each of the pair of media support members.

One advantage of the present invention is that the printed media support members are driven independent of the drive used to feed a media sheet through the printer. Still another advantage is the ability to use the media support members to contact, e.g., by tapping or squeezing, the longitudinal edges of the printed sheets accumulated in the output bin to vertically align the accumulated sheets, and thus avoid random skewing of individual sheets of the multiple printed sheets as the sheets are accumulated in the output bin.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Figure 1:
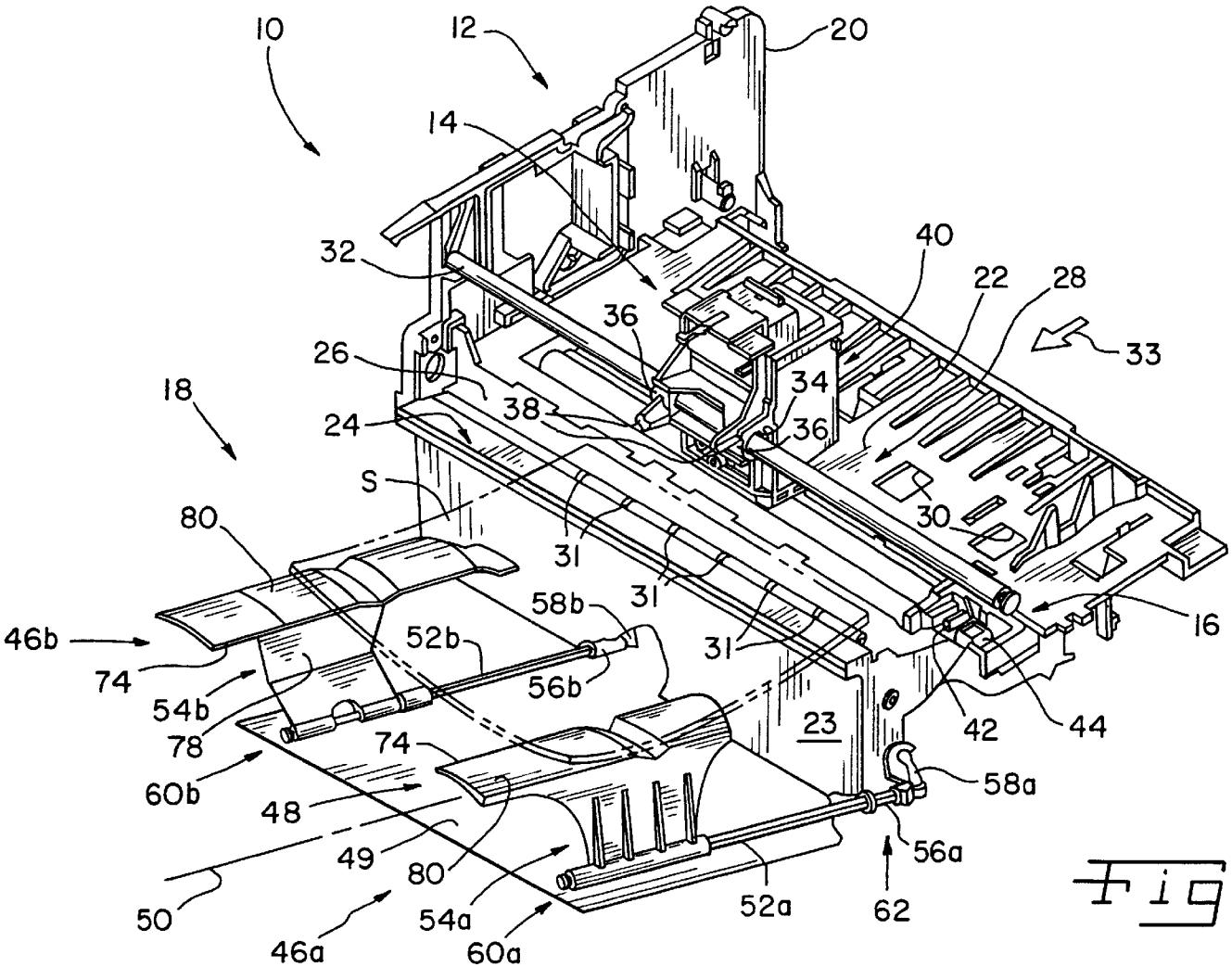
FIG. 1 is partial perspective view of a printer including the present invention.

Corresponding reference characters indicate corresponding parts throughout the several views. The exemplifications set out herein illustrates one preferred embodiment of the invention, in one form, and such exemplifications are not to be construed as limiting the scope of the invention in any manner.

DETAILED DESCRIPTION OF THE INVENTION

Referring now to the drawings and particularly to FIG. 1, there is shown a portion of a printer 10, which includes a printer frame 12, a print cartridge carrier assembly 14, a maintenance assembly 16 and an active print media handling mechanism 18. Print media handling mechanism 18 is shown in the media support position with a media sheet S (shown by phantom lines) being supported thereby.

Printer frame 12 includes two side frames 20, only one of which is shown, a middle frame 22 and an end wall 23. Middle frame 22 is mounted between the two side frames 20 and has an end portion 24 and an upper surface 26. End portion 24 defines an exit port of printer 10, and upper surface 26 defines the lower side of a media feed path 28. Each media sheet is advanced through the printer media path 28 by opposing pairs of feed rolls (not shown) in a conventional manner. Middle frame 22 is provided with a plurality of holes 30 so that feed rolls located below the frame may coact with feed rolls above the frame to feed the media sheet along upper surface 26 of middle frame 22. Middle frame 22 is further equipped with an exit assembly including exit rollers 31 positioned near end portion 24 for transporting the printed sheets out of exit port 24. A detachable guide rod 32 is supported by and extends between the two side frames 20, and further extends transverse to the media sheet feed direction, indicated by arrow 33, and is located above media feed path 28 for supporting carrier assembly 14.

Carrier assembly 14 includes slide bearings 34 housed within two bearing housings 36 which slidably receive guide rod 32. Carrier assembly 14 includes two sets of belt gripper jaws 38. Gripper jaws 38, together with a belt (not shown), are driven by a bi-directional motor (not shown) which moves carrier assembly 14 and an associated print cartridge 40 back and forth along guide rod 32.

Maintenance assembly 16 includes a wiper 42 and capping unit 44. Wiper 42 is used for cleaning a nozzle plate (not shown) of print cartridge 40 . Capping unit 44 is used to provide a seal around the nozzle plate during periods of non-use to prevent the ink which accumulates in the nozzles of the nozzle plate from drying and clogging the nozzle openings. A maintenance cycle is effected in a known manner by transporting carrier assembly 14 along guide rod 32 until the nozzle plate of print cartridge 40 is wiped by wiper 42. At the end of a printing cycle, carrier assembly 14 is transported along guide rod 32 until the nozzle plate of print cartridge 40 approaches the capping unit, and then capping unit 44 is raised to cap the nozzle plate.

As shown in FIG. 1, a portion of printer frame 12 is broken away to more clearly view active media handling mechanism 18. Active media handling mechanism 18 is attached to printer frame 12 to receive printed sheets which are expelled from exit port 24. Media handling mechanism 18 includes a pair of winged support assemblies 46*a*, 46*b*, which define a media bin 48. The surface on which printer 10 rests can serve as a bottom of media bin 48, or alternatively, an optional media base 49 may be used. Winged support assemblies 46*a*, 46*b* are pivotally attached to end wall 23 of printer frame 12, and are symmetrically arranged and spaced apart from a centerline 50 of media feed path 28. Optional tray base 49 is adapted for attachment to printer frame 12.

Winged support assembly 46*a* includes a pivot axle 52*a*, a media support member 54*a*, a frame bushing 56*a* and a cam follower linkage 58*a*. Likewise, winged support assembly 46*b* includes a pivot axle 52*b*, a media support member 54*b*, a frame bushing 56*a* and a cam follower linkage 58*b*.

Pivot axles 52*a*, 52*b* have a D-shaped cross section shape, and media support members 54*a*, 54*b* include apertures 60*a*, 60*b*, respectively, having a corresponding "D" shape. Thus, the cross section shape of pivot axles 52*a*, 52*b* facilitates axial slidable coupling to media support members 54*a*, 54*b*, respectively, and further facilitates the radial drive of media support members 54*a*, 54*b*, respectively, relative to the axial extent of pivot axles 52*a*, 52*b*. Frame bushings 56*a*, 56*b* are attached to pivot axles 52*a*, 52*b*, respectively, near the driven ends 62 thereof, and are rotatably mounted to end wall 23 of printer frame 12, to thereby pivotally mount media support members 54*a*, 54*b* to printer frame 12. A cam follower linkage 58*a*, 58*b*, is attached to driven ends 62 of pivot axles 52*a*, 52*b*, respectively.

Figure 2:
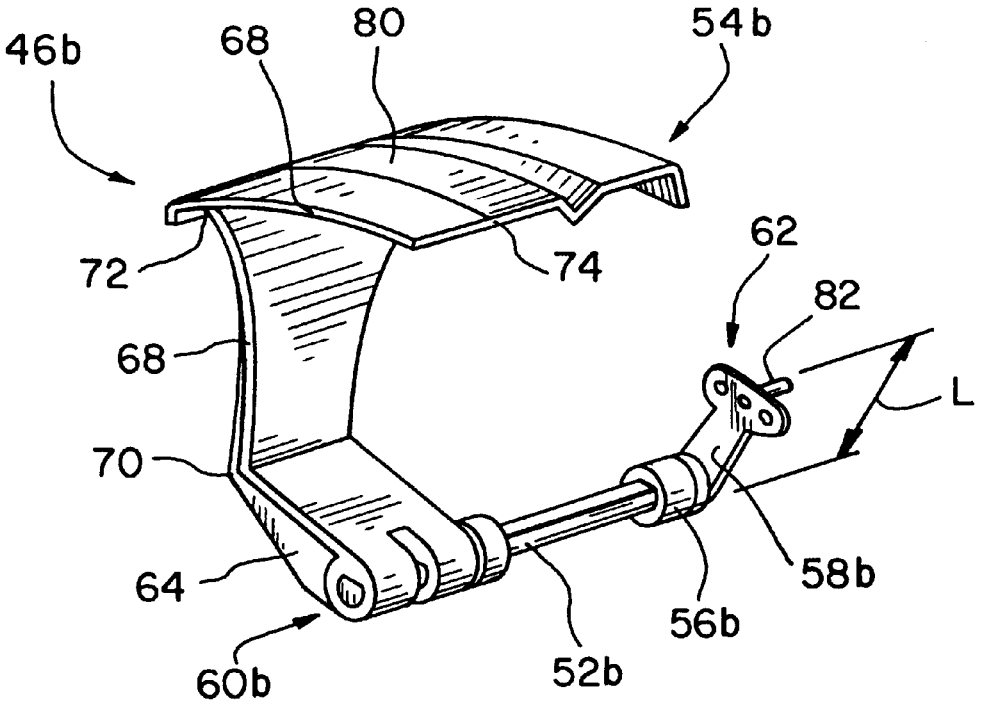
FIG. 2 is perspective view of a winged support member of the present invention;.

FIG. 2 shows a detailed view of winged support assembly 46*b* separated from printer frame 12. Winged support assembly 46*b* is symmetrically identical to winged support assembly 46*a*. Accordingly, only winged support assembly 46*b* will be discussed in detail for simplicity of discussion and ease of understanding. It is to be understood that the discussion which follows regarding winged support assembly 46*b* and media support member 54*b* also applies to winged support assembly 46*a* and media support member 54*a*. Media support member 54*b* of winged support assembly 46*b* includes a mounting portion 64, a joining wall portion 66 and a media support portion 68. Joining wall portion 66 integrally connects mounting portion 64 to media support portion 68. Mounting portion 64 extends outwardly and upwardly from pivot axle 52*b* to form a terminating end 70. Joining portion 66 extends upwardly from terminating end 70 to form an upper end 72, and is maintained in a substantially vertical orientation when print media handling mechanism 18 is in a media sheet support, or receiving, position (see FIG. 1). Media support portion 68 extends inwardly away from upper end 72 to form a support end 74.

Joining wall portion 66 includes a contact surface 78 which is used by printer 10 to lightly contact, e.g., by tapping or squeezing, the longitudinal edges of accumulated printed sheets to vertically align the accumulated sheets in media bin 48. Media support portion 68 includes a wing surface 80 which provides temporary support for a printed sheet after it is initially received by print media handling mechanism 18.

Cam follower linkage 58*b* extends perpendicularly away from pivot axle 52*b*. A cam follower 82 extends from cam follower linkage 58*b* in a direction parallel to the axial extent of pivot axle 52*b*. A length L of cam follower 58*b* linkage is defined by the distance of separation between an axis of rotation of pivot axle 52*b* and an axis of the axial extent of cam follower 82.

Figure 3:
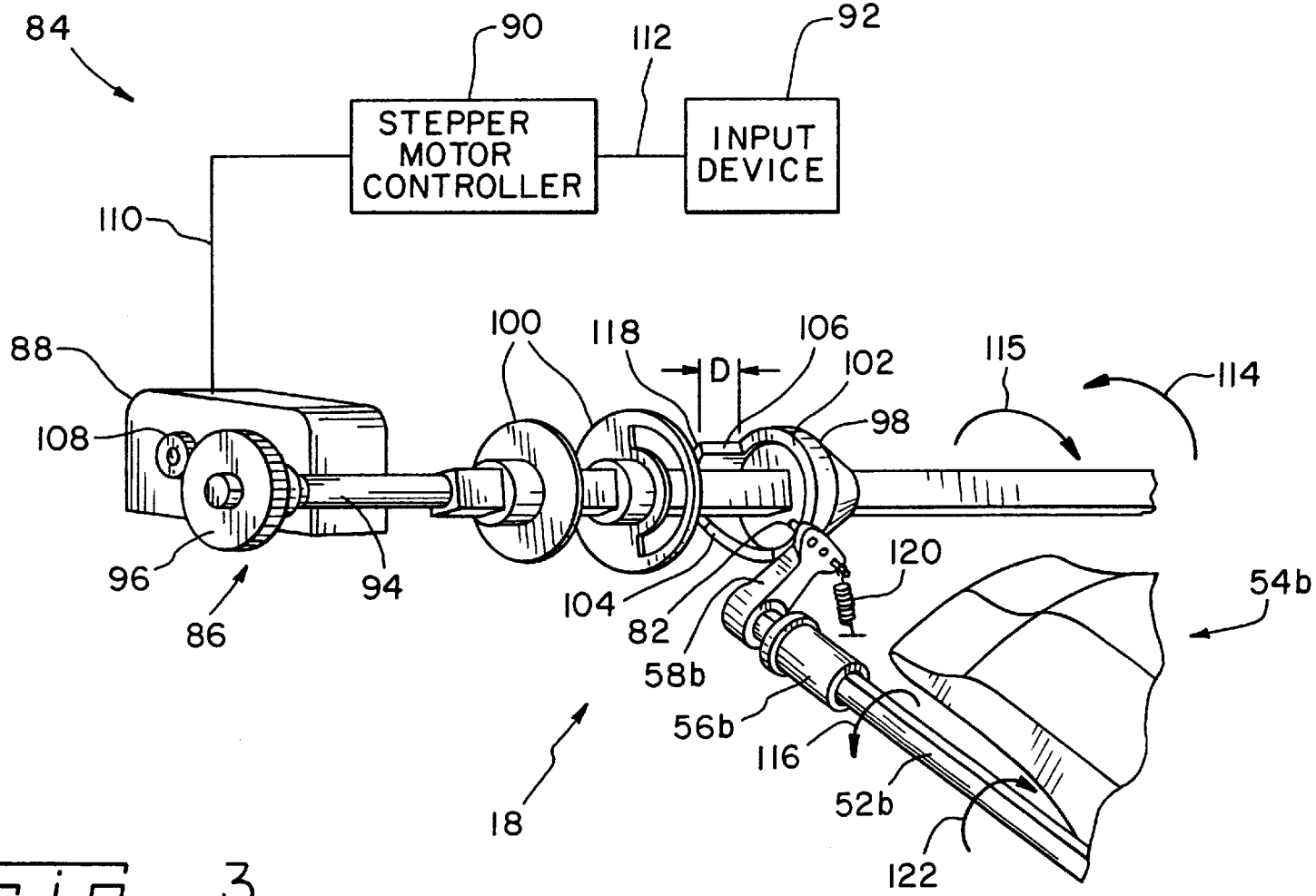
FIG. 3 is a schematic illustration of a control system of the present invention.

FIG. 3 illustrates by perspective view and partial schematic a control system 84 which operates and controls the operation of media handling mechanism 18. Control system 84 includes a drive shaft assembly 86, a stepper motor 88, a stepper motor controller 90 and an input device 92. In FIG. 3, only the drive for the left winged support assembly 46*b* is shown for simplicity of discussion and ease of understanding, however, it is to be understood that the discussion that follows also applies to the mechanism which provides driving force to right winged support assembly 46*a*. The terms "left" and "right" are relative terms and define the orientation of components as they appear in FIG. 1.

Drive shaft assembly 86 includes a drive shaft 94, a driven gear 96, a media handling cam 98 and, optionally, auxiliary cams 100. Media handling cam 98 is attached to drive shaft 94 at a location such that when drive shaft assembly 86 is installed in printer 10, the various cam surfaces 102 and 104 of cam 98 can engage cam follower 82. Auxiliary cams 100, and sensor flags, may be used to drive auxiliary printer equipment which can operate on the same operation cycle as print media handling mechanism 18. Driven gear 96 is also attached to drive shaft 94 and includes teeth which mesh with the teeth of a drive gear 108 of stepper motor 88. Stepper motor 88 is electrically coupled via conductor 1 10 to stepper motor controller 90, which in turn is coupled via conductor 112 to input device 92.

Input device 92 can be, for example, a printer controller of printer 10 which processes information relevant to the operation of printer 10, and which provides control outputs to the various operational units of printer 10, including for example, a media sheet feed, the print engine, and media handling mechanism 18. With respect to media handling mechanism, the information can include, for example, ambient environment information, media sheet positional information and ink drying information. Alternatively, input device 92 can include a sensor located in the media sheet feed path to detect the delivery of media sheet S to media handling mechanism 18, and/or ambient conditions, and associated logic for processing output from the sensor.

Input device 92 generates a stepper motor control signal based on received information, which is supplied to stepper motor 90. The stepper motor control signal may result in the operation of stepper motor 90 at regular intervals, depending upon the sheet stacking conditions of media bin 48. Stepper motor 90 rotates drive gear 108 in a predefined direction to effect a rotation of drive shaft 94 in a counter-clockwise direction indicated by arrow 114, or in a clockwise direction as indicated by arrow 115. As shaft 94 rotates, cam follower 82 traverses the cam surface regions 102 and 104.

A spring 120 maintains cam follower 82 in contact with cam 98. Thus, spring 120 biases winged support assembly 46*b* inwardly, toward centerline 50 of media path 28. While spring 120 is shown connected to "ground", in which two springs 120 would be required to bias winged support assemblies 46*a,* 46*b,* a single spring could be used which is connected between winged support assemblies 46*a,* 46*b.*

When cam follower 82 is present in cam region 102, no rotational motion, or displacement is applied to pivot axle 52*b.* The angular extent of cam region 102 may be selected to provide the desired amount of delay from the time drive axle 114 begins rotating until the time follower 82 reaches the beginning of transitional cam region 104.

As cam follower 82 traverses transitional cam region 104 as a result of the rotation of drive shaft 94 in the direction 114, a rotational motion, or displacement, is applied to pivot axle 52*b* resulting in a rotation of pivot axle 52*b* in a direction depicted by arrow 116. The cam profile of transitional cam surface 104 will influence the amount and rate of rotation of pivot axle 52*b.* For example, a distance D represents the maximum lateral extent 118, or lift, of transitional cam region 104 from cam region 102, which along with a length L of cam follower linkage 58*b,* determines the amount of pivotal rotation of pivot axle 52*b* in direction 116. The rotational point-to-point extent of transitional cam region 104 from the junction of cam surface portions 102 and 104 to maximum lateral extent 118, and the rate of rotation of drive shaft 94, determines a rate of rotation of pivot axle 52*b.*

Preferably, cam follower 82 does not traverse maximum lateral extent 118 to contact surface 106. Rather, the direction of rotation of drive shaft 94 is reversed, as depicted by arow 115, which in turn effects rotation of pivot axle 52*b* in the direction depicted by arrow 122, so that cam follower 82 travels back down transitional cam region 104 toward cam surface 102.

The operation of print media handling mechanism 18 of printer 10 will now be described with reference to FIGS. 1–4.

Referring now to FIG. 1, printing takes place in a conventional manner. As a media sheets is fed under print cartridge 40 in the direction of arrow 33, print cartridge carrier assembly 14 is moved back and forth over the media sheet S as ink within print cartridge 40 is ejected from the nozzles. Data to be printed is received by the printer controller which converts or reformats the data and sends electrical signals to print cartridge 40 to control ejection of ink from the nozzle plate. The controller commands media sheet S to be expelled out of exit port 24, and the expelled media sheet S is received by active print handling mechanism 18.

As shown in FIG. 1, print handling mechanism 18 is oriented in the sheet support position, and thus, the media sheet S is positioned on winged support assemblies 46*a,* 46*b* with a non-printed side of sheet S contacting and being supported by wing surfaces 80 of media support portions 68 of winged support assemblies 46*a,* 46*b.* At this time, cam followers 82 of each of winged support assemblies 46*a,* 46*b* are in contact with respective cam surfaces 102. Preferably, the curvature of support surfaces 80 is centered on respective pivot shaft 52*a,* 52*b* so that sheet S is not lifted as wing support assemblies 46*a,* 46*b* are rotated to the media drop position.

Referring now to FIGS. 2 and 3, at a prescribed time following the receipt of media sheet S by print media handling mechanism 18, input device 92 generates a stepper motor control signal, which is supplied to stepper motor 90 via conductor 112. Stepper motor 90 then rotates drive gear 108 in a predefined manner to effect a rotation of drive shaft 94 in the direction indicated by arrow 114. As shaft 94 rotates, cam follower 82 traverses the various cam surface regions 102, 104 of media handling cam 98.

When respective cam followers 82 are present in respective cam regions 102, and drive shaft 94 is rotated, no rotational displacement is applied to pivot axles 52*a,* 52*b,* and print handling mechanism 18 remains in the sheet support position. As respective cam followers 82 reach respective transitional cam regions 104, a rotational displacement is applied to pivot axles 52*a,* 52*b* resulting in a rotation of pivot axles 52*a,* 52*b* in opposing rotational directions. In turn, winged support assemblies 46*a,* 46*b,* which are spring biased toward centerline 50, begin to rotate away from centerline 50 to increase the spacing between the support ends 74 of media support members 54*a,* 54*b.*

Figure 4:
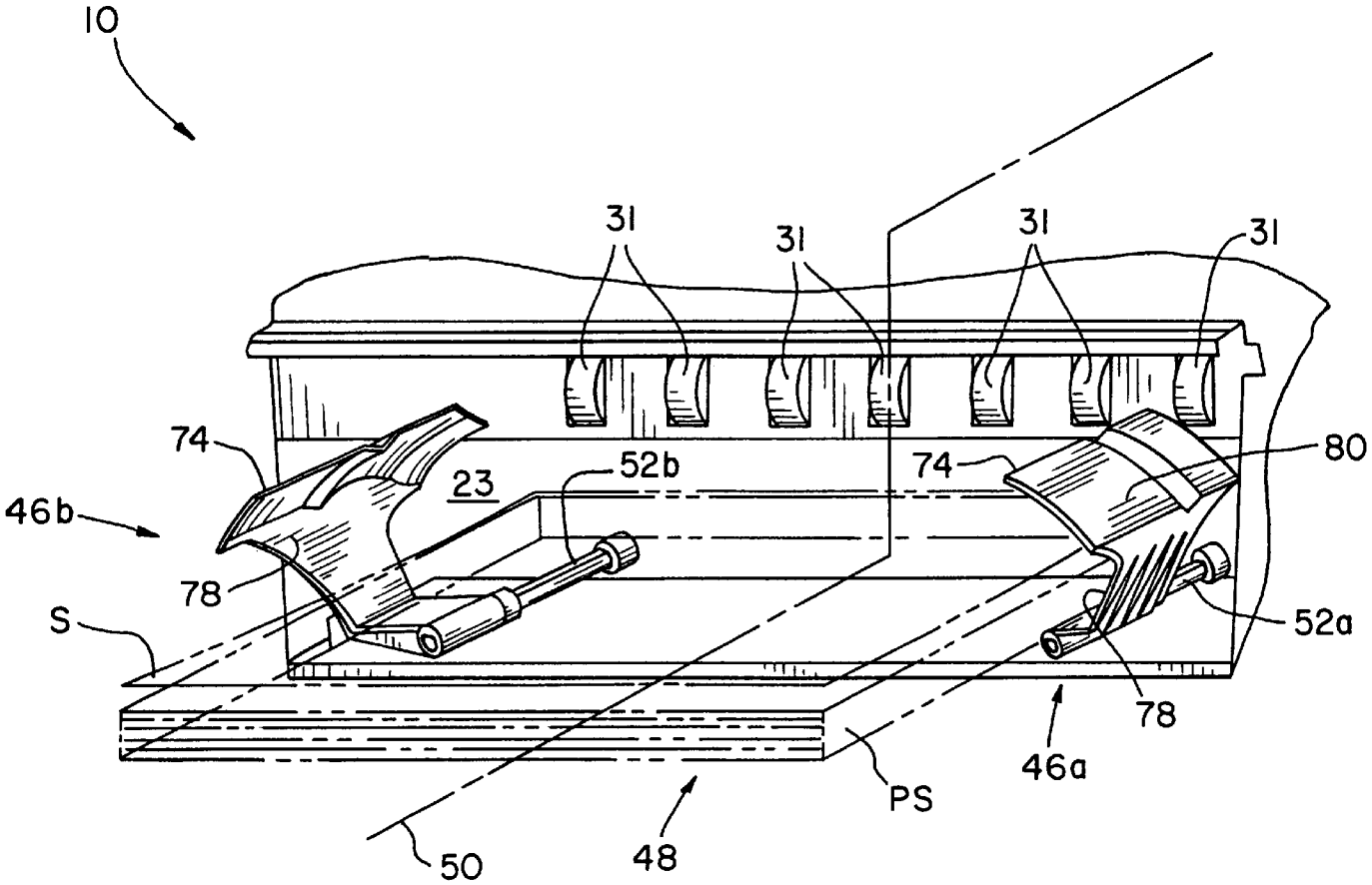
FIG. 4 is partial perspective view of the printer if FIG. 1, wherein the winged support members are in a media drop position.

FIG. 4 shows a partial front perspective view of printer 10, and illustrates print media handling system 18 in the media drop position, and with winged support assemblies 46*a,* 46*b* positioned at their greatest extent of spacing between support ends 74. This greatest extent of spacing needs only be sufficient to permit a printed sheet to fall into media bin 48. As cam follower 82 traverses transitional cam region 104, the spacing between support ends 74 of media support members 54*a,* 54*b* continues to increase, and ultimately sheet S falls by the effects of gravity into media bin 48 to join the plurality of printed sheets PS already contained therein.

Referring again to FIG. 3, at this time the rotational direction of drive axle 94 is reversed to rotate in direction 15, and respective cam followers 82 traverses back down transitional cam surfaces 104. Thus, cam followers 82 travel from maximum lateral extent 118 back to cam surfaces 102 to effect a reverse pivotal rotation of pivot axles 52*a* 52*b,* and in turn winged support assemblies 46*a,* 46*b* move toward media path centerline 50 to decrease the spacing between the support ends 74 of media support members 54*a,* 54*b.* As media support members 54*a,* 54*b* are returned to the media support position, contact surfaces 78 (see FIG. 4) of media support members 54*a,* 54*b* contact, e.g., lightly tap, the longitudinal edges of the printed sheets accumulated in media bin 48 to vertically align the accumulated sheets.

Preferably, print media handling system 18 is controlled independently from the media sheet feed of printer 10, such that movement of print handling mechanism 18 between the sheet support position and the media drop position is not dependent upon the status of the media sheet feed of printer 10. Thus, print handling mechanism 18 can be cycled through the sheet support position and the media drop position regardless of whether a media sheet is present on wing surfaces 80 of media support members 54*a,* 54*b,* thereby effecting the intermittent contact of contact surfaces 78 with opposing longitudinal edges of the accumulated sheets to further enhance the alignment of the printed sheets in bin 48. This intermittent contact, e.g., tapping or squeezing, can be effected by input device 92 and/or stepper motor controller 90 to occur at either regular intervals or irregular intervals, depending upon the sheet stacking conditions of media bin 48. Also, media handling mechanism 18 can be maintained in the media drop position by ceasing rotation of drive shaft 94 at the appropriate time.

By contacting, e.g., tapping or squeezing, the opposing longitudinal edges of the printed sheets accumulated in bin 48, the vertically alignment of the accumulated sheets is improved and the effective capacity of media bin 48 is increased.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A print media handling system for an imaging apparatus having a media feed path, comprising:

a pair of media support members, each having a first wall defining a media contact surface and a support portion defining a media support surface, said pair of media support members being pivotally mounted to said imaging apparatus for symmetrical operation with respect to a centerline of said media feed path, said pair of media support members defining a media bin for receiving printed media; and a drive system for operating said pair of media support members between a first position wherein said media support surface of said pair of support members carries a printed media sheet and a second position wherein said printed media sheet is released to fall into said media bin, said drive system further controlling said pair of media support members such that said contact surface of each of said pair of media support members contacts opposing edges of said printed media to align said printed media in said media bin.

2. The system of claim 1, wherein said drive system controls said pair of media support members to contact said opposing edges of said printed media accumulated in said media bin on an intermittent basis, regardless of the presence of a printed sheet of media at said media support surface of each of said pair of media support members.

3. The system of claim 2, wherein said intermittent basis comprises regular intervals.

4. The system of claim 2, wherein said intermittent basis comprises irregular intervals.

5. The system of claim 1, wherein said drive system comprises:

a motor having a drive gear;

a motor controller electrically coupled to said motor;

an input device electrically coupled to said motor controller;

a drive shaft having a driven gear for mechanical engagement with said drive gear;

a first cam and a second cam attached to said drive shaft, each of said first cam and said second cam having a cam profile defining a cam surface;

a first pivot axle having a first drive end and a second pivot axle having a second drive end;

a first cam follower coupled to said first drive end of said first pivot axle, said first cam follower engaging said cam surface of said first cam;

a second cam follower coupled to said second drive end of said second pivot axle, said second cam follower engaging said cam surface of said second cam; and said first pivot axle being connected to a first media support member of said pair of media support members, and said second pivot axle being connected to a second media support member of said pair of media support members.

6. The system of claim 5, wherein each of said pair of media support members is biased by a spring in a direction toward said centerline.

7. The system of claim 6, wherein said cam surface includes a cam portion which effects a rotation rate of said first pivot axle and said second pivot axle.

8. An ink jet printer, comprising:

a structure defining a media feed path;

a pair of media support members, each having a first wall defining a media contact surface and a support portion defining a media support surface, said pair of media support members being pivotally mounted to said imaging apparatus for symmetrical operation with respect to a centerline of said media feed path, said pair of media support members defining a media bin for receiving printed media; and a drive system for operating said pair of media support members between a first position wherein said media support surface of said pair of support members carries a printed media sheet and a second position wherein said printed media sheet is released to fall into said media bin, said drive system further controlling said pair of media support members such that said contact surface of each of said pair of media support members contacts opposing edges of said printed media to align said printed media in said media bin.

9. The ink jet printer of claim 8, wherein said drive system controls said pair of media support members to tap said opposing edges of said printed media accumulated in said media bin on an intermittent basis, regardless of the presence of a printed sheet of media at said media support surface of each of said pair of media support members.

10. The ink jet printer of claim 9, wherein said intermittent basis comprises regular intervals.

11. The ink jet printer of claim 9, wherein said intermittent basis comprises irregular intervals.

12. The ink jet printer of claim 8, wherein said drive system comprises:

a motor having a drive gear;

a motor controller electrically coupled to said motor;

an input device electrically coupled to said motor controller;

a drive shaft having a driven gear for mechanical engagement with said drive gear;

a first cam and a second cam attached to said axle, each of said first cam and said second cam having a cam profile defining a cam surface;

a first pivot axle having a first drive end and a second pivot axle having a second drive end;

a first cam follower coupled to said first drive end of said first pivot axle, said first cam follower engaging said cam surface of said first cam;

a second cam follower coupled to said second drive end of said second pivot axle, said second cam follower engaging said cam surface of said second cam; and said first pivot axle being connected to a first media support member of said pair of media support members, and said second pivot axle being connected to a second media support member of said pair of media support members.

13. The ink jet printer of claim 12, wherein each of said pair of media support members is biased by a spring in a direction toward said centerline.

14. The ink jet printer of claim 13, wherein said cam surface includes a cam portion which effects a rotation direction of said first pivot axle and said second pivot axle.

15. A media handling method for an imaging apparatus having a media feed path, comprising:

providing a pair of media support members, each having a first wall defining a media contact surface and a second wall defining a media support surface, said pair of media support members being pivotally mounted to said imaging apparatus for symmetrical operation with respect to a centerline of said media feed path, said pair of media support members defining a media bin for receiving printed media;

operating said pair of media support members between a first position wherein said media support surface of said pair of support members carries a printed media sheet and a second position wherein said printed media sheet is released to fall into said media bin;

controlling said pair of media support members such that said contact surface of each of said pair of media support members contacts opposing edges of said printed media to align said printed media in said media bin.

16. The method of claim 15, wherein said controlling step further comprises the step of controlling said pair of media support members to contact said opposing edges of said printed media accumulated in said media on an intermittent basis, regardless of the presence of a printed sheet of media at the media support surface of each of said pair of media support members.

17. The method of claim 15, wherein said controlling step effects contact by tapping said opposing edges of said printed media.

18. The method of claim 15, wherein said controlling step effects contact by squeezing said opposing edges of said printed media.

* * * * *